US007399144B2

(12) United States Patent
Kallen

(10) Patent No.: US 7,399,144 B2
(45) Date of Patent: Jul. 15, 2008

(54) APPARATUS AND METHOD FOR STABILIZING AN EARTHEN EMBANKMENT

(76) Inventor: Michael Charles Kallen, 32805 Richards Ave., Mission (CA) V2V 7E7

( * ) Notice: Subject to any disclaimer, the term of this patent is extended or adjusted under 35 U.S.C. 154(b) by 501 days.

(21) Appl. No.: 10/546,518

(22) PCT Filed: Feb. 23, 2004

(86) PCT No.: PCT/CA2004/000254

§ 371 (c)(1),
(2), (4) Date: Aug. 23, 2005

(87) PCT Pub. No.: WO2004/076751

PCT Pub. Date: Sep. 10, 2004

(65) Prior Publication Data

US 2006/0239783 A1 Oct. 26, 2006

Related U.S. Application Data

(60) Provisional application No. 60/449,392, filed on Feb. 25, 2003.

(51) Int. Cl.
*E02D 17/18* (2006.01)

(52) U.S. Cl. ..... 405/284; 405/302.7

(58) Field of Classification Search ..... 405/302.7, 405/284, 302.4

See application file for complete search history.

(56) References Cited

U.S. PATENT DOCUMENTS 5,522,682 A 6/1996 Egan
5,531,547 A 7/1996 Shimada
5,975,810 A 11/1999 Taylor et al.
6,345,934 B1 2/2002 Jailloux et al.
6,595,726 B1 7/2003 Egan et al.
6,679,656 B1 * 1/2004 Manthei ..... 405/284

FOREIGN PATENT DOCUMENTS

GB 2295180 A 5/1996
JP 2209522 8/1990
JP 2001049668 A * 2/2001
JP 2003-049433 A 2/2003

OTHER PUBLICATIONS

Patent Abstracts of Japan, JP 2002-309582 (Tenryu Ind Co Ltd) published Oct. 23, 2002 and related JPO English language translation by computer.

* cited by examiner

*Primary Examiner*—John Kreck
(74) *Attorney, Agent, or Firm*—Lance A. Turlock

(57) ABSTRACT

A structure for stabilizing an earthen embankment comprises an embankment support for restraining movement of at least a part of the embankment, a flexible fiber geogrid (5) extending longitudinally through the embankment from a first end portion secured to the support to a second end portion, and anchor means (55, 60, 11) for securing one of the end portions. The anchor means comprises a pair of anchor rods (55, 60) extending transversely in relation to the geogrid, and means (11) for limiting movement of the anchor rods. The end portion secured by the anchor means is wrapped back and forth around the anchor rods so as to tighten thereon when the geogrid is pulled in longitudinal tension away from the anchor means. A method of anchoring a flexible fiber geogrid to a support utilizing such anchor rods is also disclosed.

15 Claims, 13 Drawing Sheets

APPARATUS AND METHOD FOR STABILIZING AN EARTHEN EMBANKMENT

CROSS-REFERENCE TO RELATED APPLICATIONS

This application is related to U.S. provisional application No. 60/449,392 filed Feb. 25, 2003, entitled "APPARATUS AND METHOD FOR STABILIZING AN EARTHEN EMBANKMENT", naming Michael Charles Kallen as the inventor. The contents of the provisional application are incorporated herein by reference in their entirety, and the benefit of the filing date of the provisional application is hereby claimed for all purposes that are legally served by such claim for the benefit of the filing date.

BACKGROUND OF THE INVENTION

The present invention relates to apparatus and methods for stabilizing earthen retaining walls or embankments.

It is well known in the prior art to stabilize earthen embankments with supports and associated geogrids extending rearwardly from the support into the stabilized embankment. This includes embankments with a slope of less than 90 degrees and embankments with a 90 degree slope. In cases where flexible fiber geogrids are used, the geogrid often is wrapped over the face of the support and under the floor of the support But, the time and labor required to instal such geogrids is substantial.

Flexible fiber geogrids are available from various sources, for example, Strata Systems, Inc. of Cumming, Ga., U.S. who provide a family of high strength polyester yarn geogrids for soil reinforcement.

U.S. Pat. No. 5,975,810 (Taylor et al.) granted on Nov. 2, 1999 discloses apparatus for securing a flexible fiber geogrid to a support without wrapping over the face of the support. In a number of embodiments there is a need to carefully fold the forward end portion of the geogrid back and forth in layers upon itself to provided improved shear strength. The layered end portion is then secured with a retaining rod which is positioned to press against the layers—in effect sandwiching the layers between the rod and the underlying support on which the layers are positioned. In the field, the required aligned folds may be considered awkward and time consuming to achieve. Further, the anchorage does not have a positive hold on the geogrid. The integrity of the anchorage when the geogrid is tensioned appears to be largely dependent upon the compressive grip which the retaining rod imposes on the folded layers. In another embodiment, Taylor et al. describe anchoring a geogrid by means of a retaining rod around which the forward end of a geogrid is folded 180 degrees backwards. However, by itself, the rod does not provide a positive hold on the geogrid. The geogrid is restrained only by the resistance of backfill which is required to be placed over the folded end portion of the geogrid before tension is applied to the geogrid. The sufficiency of the restraint will be dependent on the length of the folded end portion and frictional characteristics of the backfill, the latter of which may vary depending on dampness and other factors. To adjust for such considerations will require particular skill and expertise on the part of those determining what length a folded portion should have to achieve a desired connection strength.

Accordingly, there is a need to provide apparatus and a method for positively anchoring a flexible fiber geogrid to a support with a strong, reliable connection which requires minimal labor.

BRIEF SUMMARY OF THE INVENTION

In a broad aspect of the present invention, there is provided a structure for stabilizing an earthen embankment which comprises an embankment support for restraining movement of at least a part of the embankment, a flexible fiber geogrid extending longitudinally through the embankment from a first end portion secured to the support to a second end portion, and anchor means for securing one of the end portions. The anchor means comprises a pair of anchor rods extending transversely in relation to the geogrid, and means for limiting movement of the anchor rods. The end portion secured by the anchor means is wrapped back and forth around the anchor rods so as to tighten thereon when the geogrid is pulled in longitudinal tension away from the anchor means.

In one embodiment, the embankment support comprises a retaining wall and the means for limiting movement of the anchor rods comprises a plurality of anchor bolts, each bolt comprising a shaft extending from one end engaged with the wall to a distal end shaped to form an eyelet, one of the anchor rods extending through each of the eyelets.

In another embodiment where the embankment support also comprises a retaining wall, the earthen embankment lies between a rock face and the wall. The means for limiting movement of the anchor rods comprises a plurality of anchor bolts, each bolt comprising a shaft extending from one end engaged with the rock face to a distal end shaped to form an eyelet, one of the anchor rods extending through each of the eyelets.

In a further embodiment, the embankment support of the stabilizing structure comprises a floor section and a face section. The floor section extends longitudinally rearwardly from a forward end of the floor section to a rearward end and includes at the rearward end a plurality of transversely spaced hooking members. The face section extends upwardly from the forward end of the floor section to a top end of the face section at an angle corresponding to the slope of the embankment (i.e. up to 90 degrees). The geogrid extends longitudinally rearwardly from the floor section and is anchored thereto by first and second anchor rods extending transverse to the geogrid. Movement of the anchor rods relative to the support is limited by the hooking members when the geogrid is pulled in rearward longitudinal tension. At least in some circumstances, each hooking member preferably defines an inverted U-shaped envelope. In such cases, the geogrid preferably extends from a forward end of the geogrid:

- first forwardly above the first anchor rod, preferably a cylindrical rod, to a position above the second anchor rod, also preferably a cylindrical rod;
- then wrappingly around the second anchor rod to a position below the second anchor rod;
- then rearwardly to a position above the first anchor rod;
- then wrappingly around the first anchor rod to a position below the first anchor rod;
- then forwardly to a position below the second anchor rod;
- then wrappingly around the second anchor rod to a position above the second anchor rod;
- then rearwardly above the first anchor rod and away from the support In another aspect of the present invention, there is provided a method of anchoring a flexible fiber geogrid to a support for stabilizing an earthen embankment, the support comprising an upwardly extending face section and a floor section extending longitudinally rearwardly from the face section. The floor section comprises a plurality of transversely spaced hooking members, and the geogrid comprises longitudinally extending webs sized and spaced to fit between the hooking members. The method comprises:

positioning a forward end portion of the geogrid atop the floor section such that the longitudinally extending webs of the geogrid extend between the hooking members;

then positioning a first anchor rod atop the end portion of the geogrid rearward of the hooking members in a position where forward movement of the first anchor rod is limited by the hooking members;

then folding the end portion of the geogrid forwardly over the first anchor rod;

then positioning a second anchor rod atop the end portion of the geogrid forward of the first anchor rod in a position where rearward movement of the second anchor rod is limited by the hooking members;

then folding the end portion and the geogrid rearwardly over the second anchor rod.

The foregoing structure and method enables a flexible fiber geogrid to be anchored to a support in a quick and efficient manner without imposing undesirable stresses on the geogrid when the geogrid is tensioned in relation to the support. Another key point to note is that unlike the systems of Taylor et al. the strength of the anchoring connection (viz. the "pull-out" factor) will proportionately increase as the longitudinal tension applied to the geogrid is increased. Further, since the anchoring connection of the present invention is not dependent on placing backfill on the connection to provide resistance, the connection is necessarily independent of the quality of backfill that ultimately is added. The frictional resistance which backfill may have to offer is immaterial to the connection strength.

The foregoing and other features and advantages of the present invention will now be described with reference to the drawings.

DETAILED DESCRIPTION OF PREFERRED EMBODIMENTS

Figure 1:
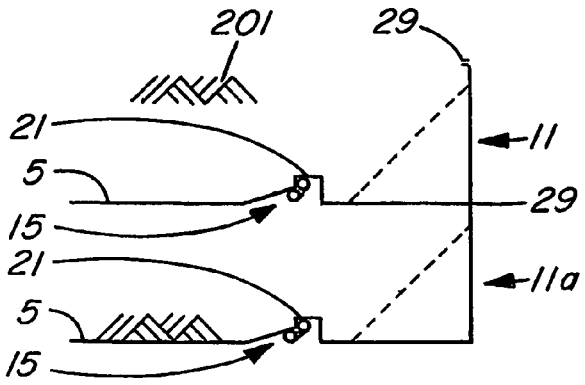
FIG. 1 is a representational cross-section elevation view of a vertical earthen embankment stabilized by apparatus in accordance with the present invention.
Figure 2:
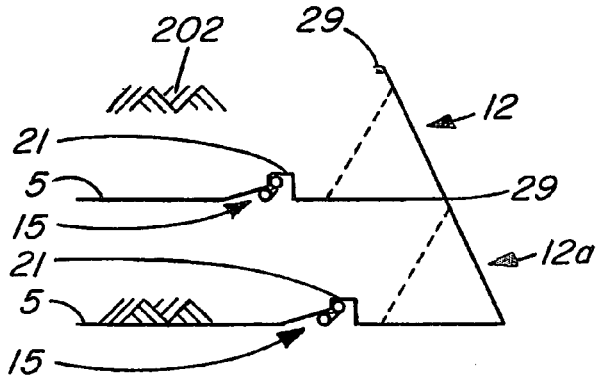
FIG. 2 is a representational cross-section elevation view of a sloped earthen embankment stabilized by apparatus in accordance with the present invention.

FIGS. 1 and 2 illustrate flexible fiber geogrids 5 anchored to embankment supports generally designated 11, 11*a*, 12, 12*a*. In FIG. 1, geogrids 5 and supports 11, 11*a* serve to stabilize a vertical earthen embankment of backfill 201. In FIG. 2, geogrids 5 and supports 12, 12*a* serve to stabilize a sloped earthen embankment of backfill 202.

Geogrids 5 are anchored to support 11 or 12, as the case may be, by a preferred anchoring mechanism which is generally designated 15 and which is described below in more detail with reference to FIG. 4-10. Each geogrid 5 comprises a plurality of spaced elongated tension members 6 extending from a forward end 7 and intersected at spaced intervals by a plurality of transverse members 8. For strength, geogrids 5 preferably are fabricated from high density polyester material.

Figure 3:
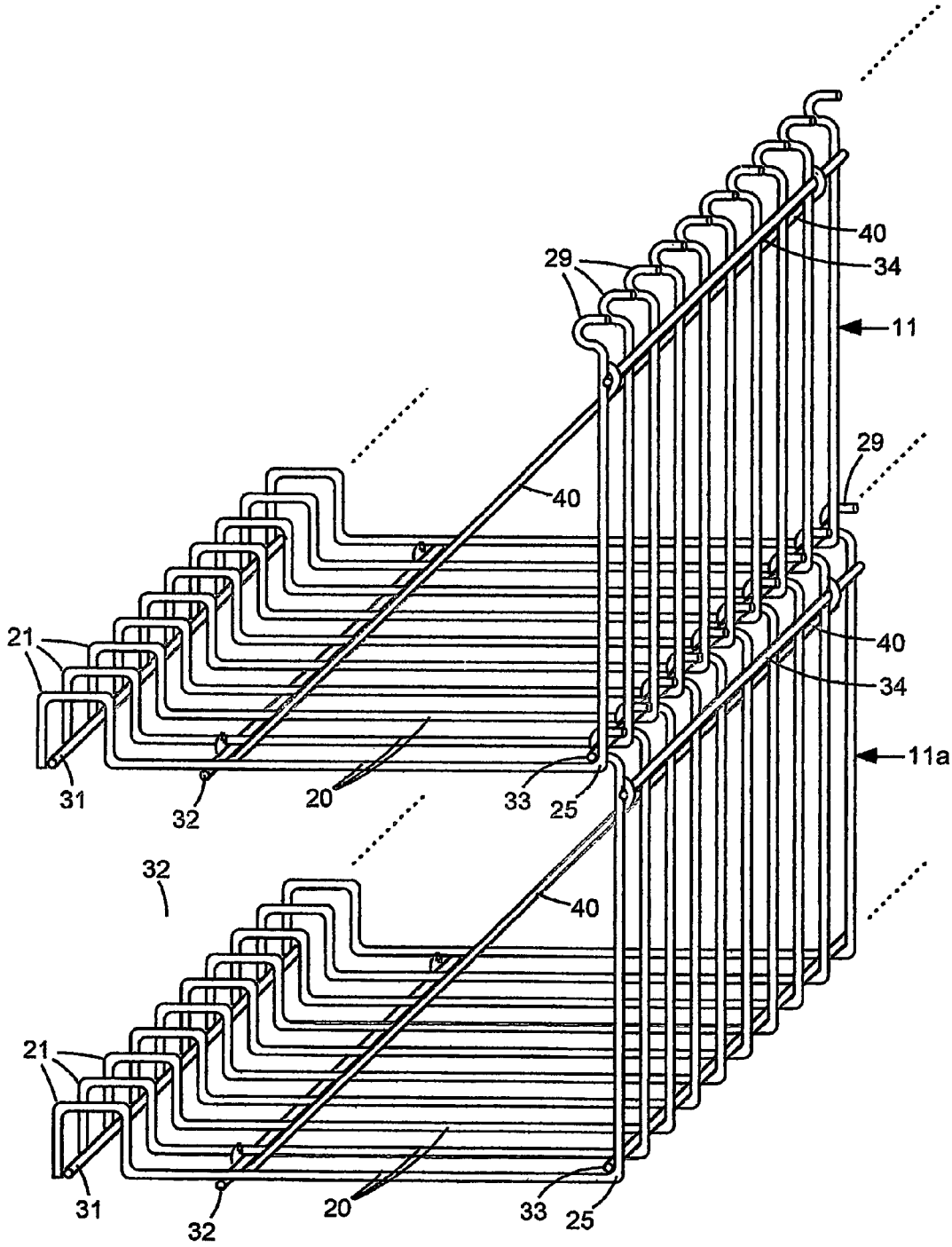
FIG. 3 is a perspective view illustrating in more detail the linking of the supports shown in FIG. 1. Similar linking is present between the supports shown in FIG. 2.

FIG. 3 illustrates the structure of supports 11, 11*a* in more detail. Note that geogrids 5 and backfill 201 have not been included in FIG. 3 so as not to obscure the structure.

Support 11 comprises a plurality of transversely spaced elongated steel wire members 20, each extending longitudinally from a hooked rearward end or hooking member 21 (which defines an inverted U-shaped envelope) to a forward end 25, then upwardly to a hooked upper end 29. The lowermost horizontally extending portion of wire members 20 together define a floor section of the support. Similarly, the forwardmost upwardly extending portion of wire members 20 together define a face section of support 11 which extends upwardly at 90 degrees relative to the floor section.

Support 11 also includes transversely extending steel wire crossbars, namely: rearward crossbar 31, intermediate crossbar 32 on the floor section, forward crossbar 33 extending proximate forward ends 25 of wire members 20, and upper crossbar 34. Each of such crossbars are welded to wire members 20 at their points of intersection therewith to hold wire members 20 in their parallel spaced relationship. As well, to provide added strength, support 11 includes a plurality of diagonal wire braces 40 each of which is hooked at its lower end to intermediate crossbar 32 and at its upper end to upper crossbar 34.

The construction of support 11*a* is substantially the same as that of support 11. During the process of stabilizing an embankment, support 11*a* of course will be installed first with its geogrid 5 anchored to the support (in the manner described below). Then, embankment backfill sufficient to provide a base for support 11 will be added over the floor section and rearwardly of support 11*a* while leaving hooked upper ends 29 of support 11*a* free to engage forward crossbar 33 of support 11.

As can be seen in FIG. 3, forward crossbar 33 of support 11 is engaged by hooked upper ends 29 of support 11*a*. The hooked upper ends 29 of support 11 are free ends but may be used to engage the upper crossbar of yet another similar support (not shown) positioned above the level of support 11. This may be repeated for several levels or tiers of supports and not merely the two levels depicted in FIGS. 1 and 3.

The only substantive difference between supports 11, 11*a* and supports 12, 12*a* is that the face section of the latter extends upwardly and rearwardly at an angle of less than 90 degrees relative to the floor section, and is thus suitable for a sloped embankment extending at the same angle. Depending on the job at hand, it will be understood that supports like supports 11, 11*a*, 12, 12*a* may be combined in the same project. For example, in FIG. 3, support 11 or support 11*a* could be replaced by a support like support 12 or with a support having some other angle between its face and floor sections.

Apart from the provision of hooked upper ends 29, the construction of supports 11, 11*a*, 12, 12*a* is considered to be prior art. The advantage provided by hooked upper ends 29 is to enable supports on successive levels to be quickly linked in the manner shown in FIG. 3 as construction of a stabilized embankment proceeds and, as each new support is added to the structure, to enable its associated geogrid to be anchored to the support and then tensioned while the support is held in position by the support to which it is linked.

Figure 4:
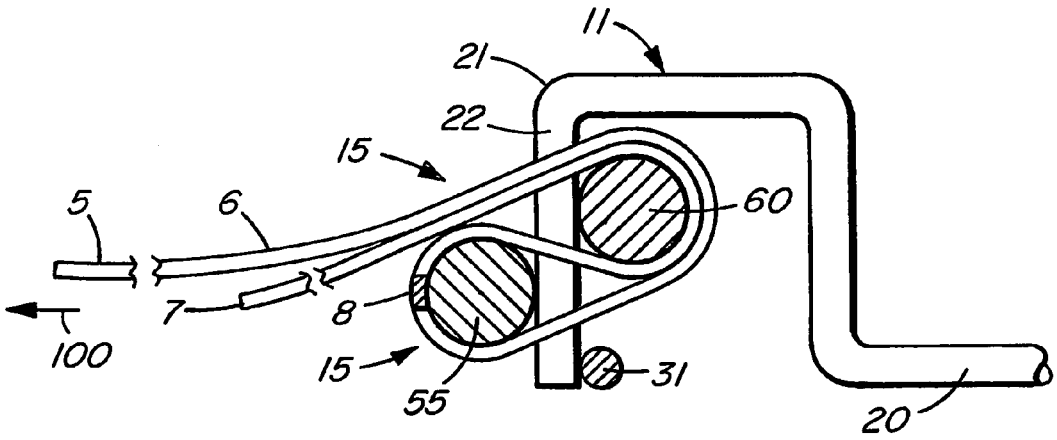
FIG. 4 is a cross-section elevation view illustrating in more detail the anchoring of a flexible fiber geogrid to an embankment support in accordance with the present invention.

Each geogrid 5 is anchored to support 11, 11*a*, 12, 12*a*, as the case may be, by first and second anchor rods (preferably cylindrical rods 55, 60): see FIGS. 4-10 for the example of support 11. When a geogrid 5 is fully anchored to support 11 as shown in FIG. 4, each rod 55, 60 extends transverse to the geogrid. Rod 55 is positioned rearward of rod 60 outside the inverted U-shaped envelope defined by end 21 and rod 60 is positioned forward of rod 55 within the envelope. As seen in FIG. 4, geogrid 5 extends from its forward end 7 first forwardly above rods 55 and 60 to a position above rod 60;

then wrappingly around rod 60 to a position below rod 60;

then rearwardly to a position above rod 55;

then wrappingly around rod 55 to a position below rod 55;

then forwardly to a position below rod 60;

then wrappingly around rod 60 to a position above rod 60;

then rearwardly above rod 55 and distantly away from support 11.

When longitudinal tension is applied to geogrid 5 in the direction of arrow 100 (FIG. 4) while support 11 is held in position the geogrid tightens on the rods; rod 55 is pulled by the geogrid forwardly against the rearward side of leg 22 of end 21; and rod 60 is pulled by the geogrid rearwardly against the forward side of leg 22. Thus, both forward movement of rod 55 and rearward movement of rod 60 are limited by leg 22.

It will be note that upward movement of rod 60 is limited because it is contained within the inverted U-shaped envelope defined by end 21. This is advantageous because when a worker pulls on the geogrid before rods 55, 60 are drawn to the final positions shown in FIG. 4, rod 60 may otherwise slip up and away from its anchoring position if the manual pulling force includes an upward component relative to support 11.

Figure 5:
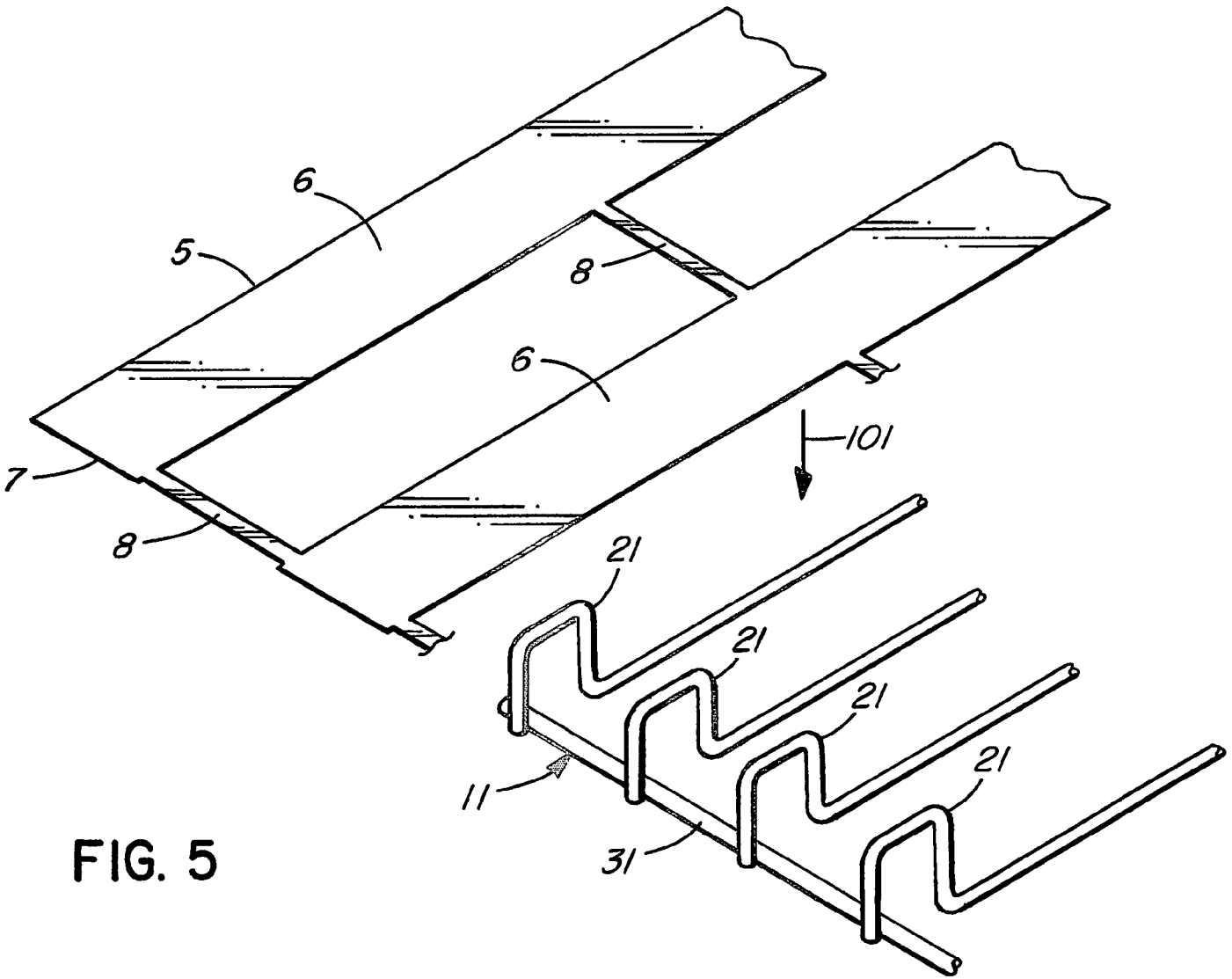
FIGS. 5 through 10 are a stepwise progression of perspective views showing a method of achieving the anchoring illustrated in FIG. 4.

Reference is now made to FIGS. 5 through 10 which illustrate a stepwise progression of steps for anchoring geogrid 5 to support 11. As shown in FIG. 5, a forward portion of geogrid 5 is first positioned above support 11 with its forward end 7 directed rearwardly. The forward portion is then lowered in the direction of arrow 101 (FIG. 5) to the position shown in FIG. 6 where the longitudinal tension members 6 of geogrid 5 fall between hooking members 21. Although not illustrated, it may be noted that the portion of geogrid 5 not shown in FIG. 5 typically will be rolled up in a form easy to be unrolled.

Figure 6:
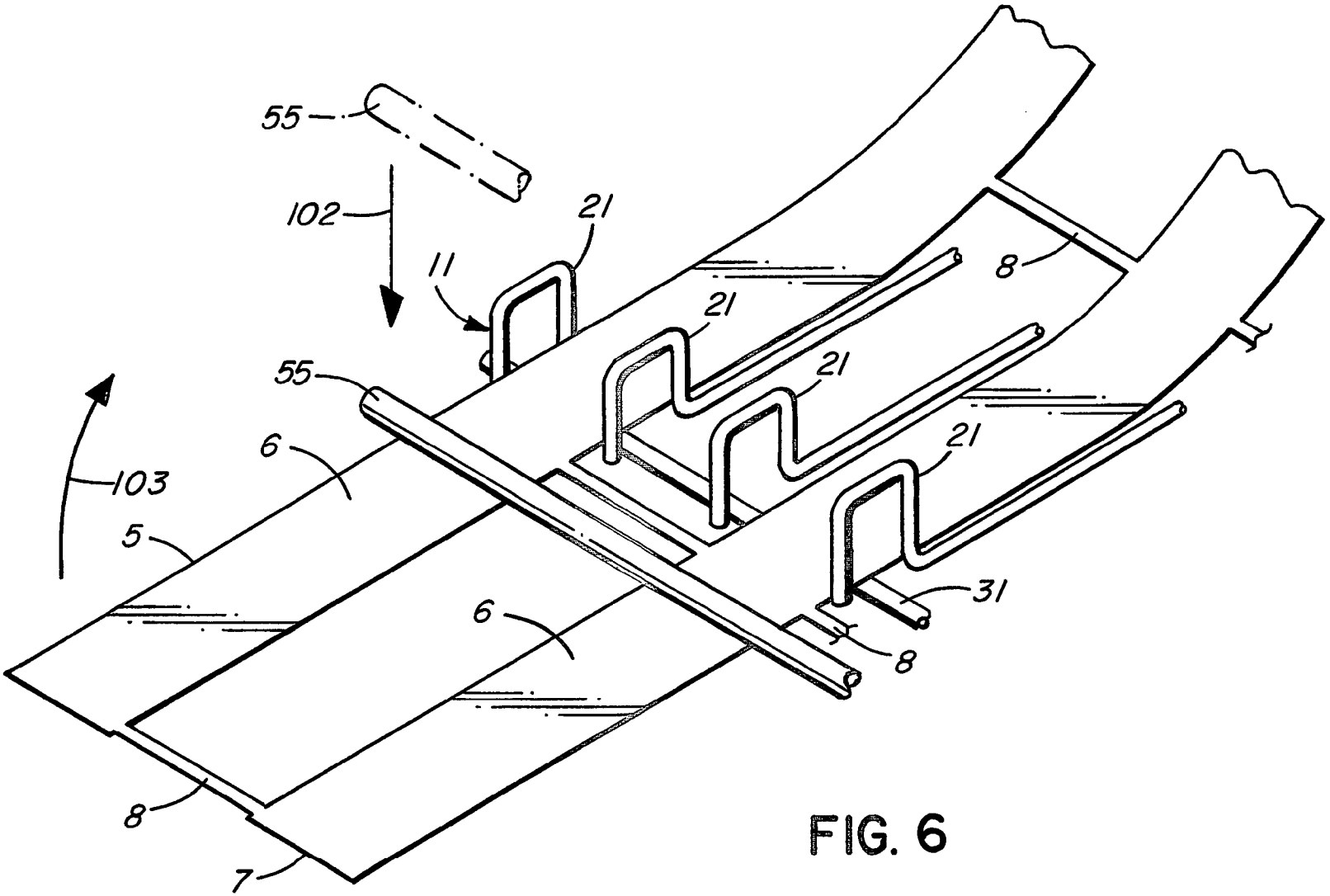

Next, anchoring rod 55 is located from a position above geogrid 5 as shown in FIG. 6 to a position atop geogrid 5 as shown in FIG. 6 (viz. in the direction of arrow 102). Then, the forward portion of geogrid 5 as shown in FIG. 6 is folded forwardly over rod 55 to the position shown in FIG. 7 (viz. in the direction of arrow 103).

Figure 7:
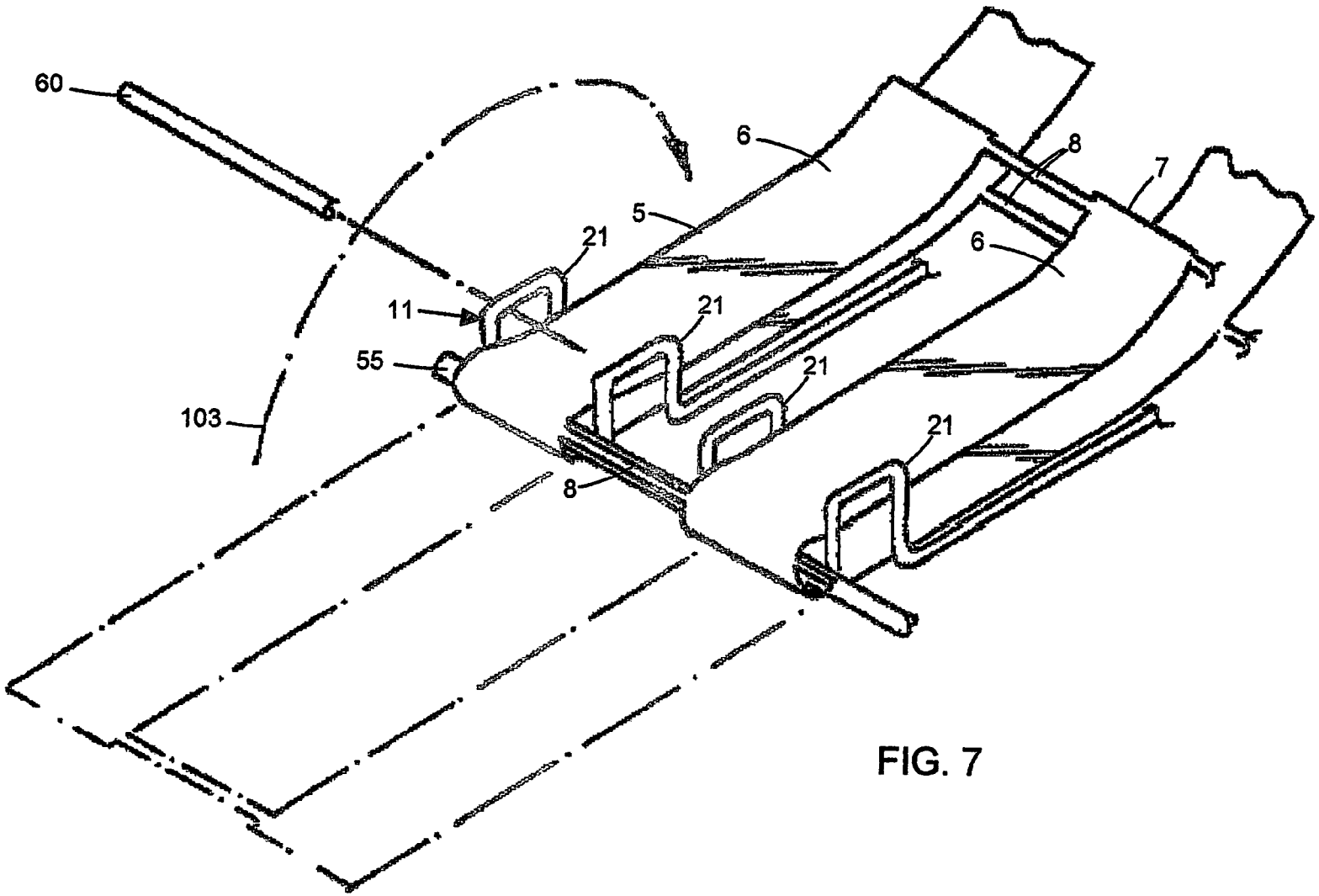
Figure 8:
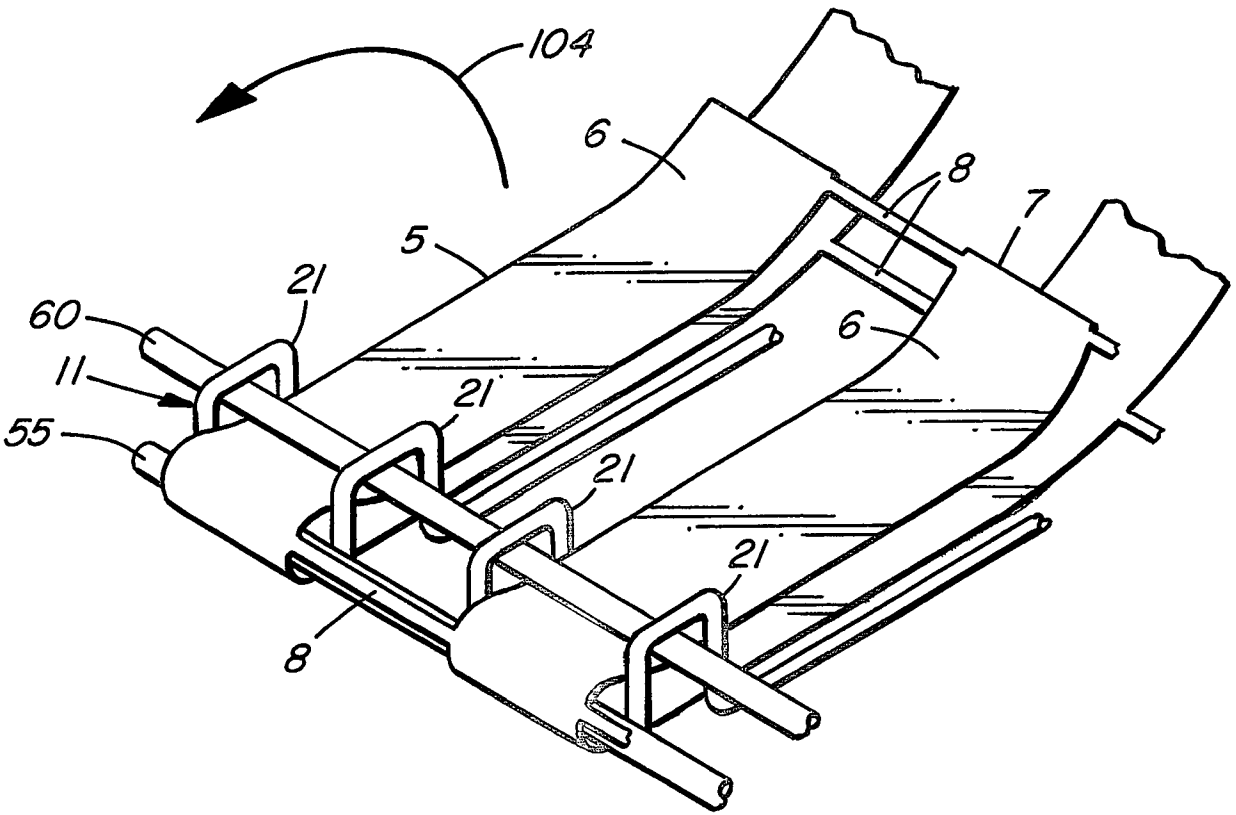

Next, as indicated in FIGS. 7 and 8, anchoring rod 60 is transversely inserted atop the forwardly folded end portion of geogrid 5 and through the inverted U-shaped envelopes provided by ends 21 of support 11.

Figure 9:
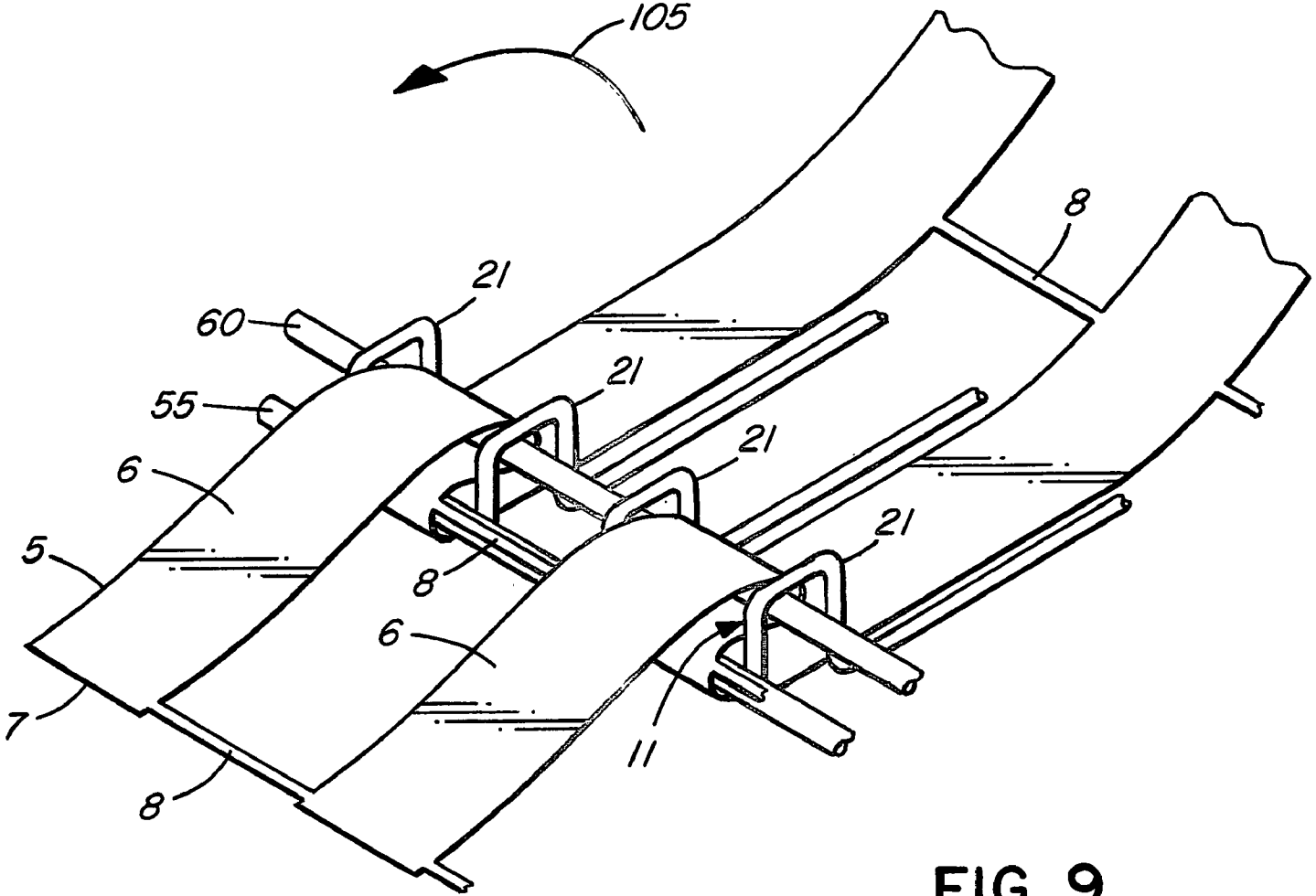
Figure 10:
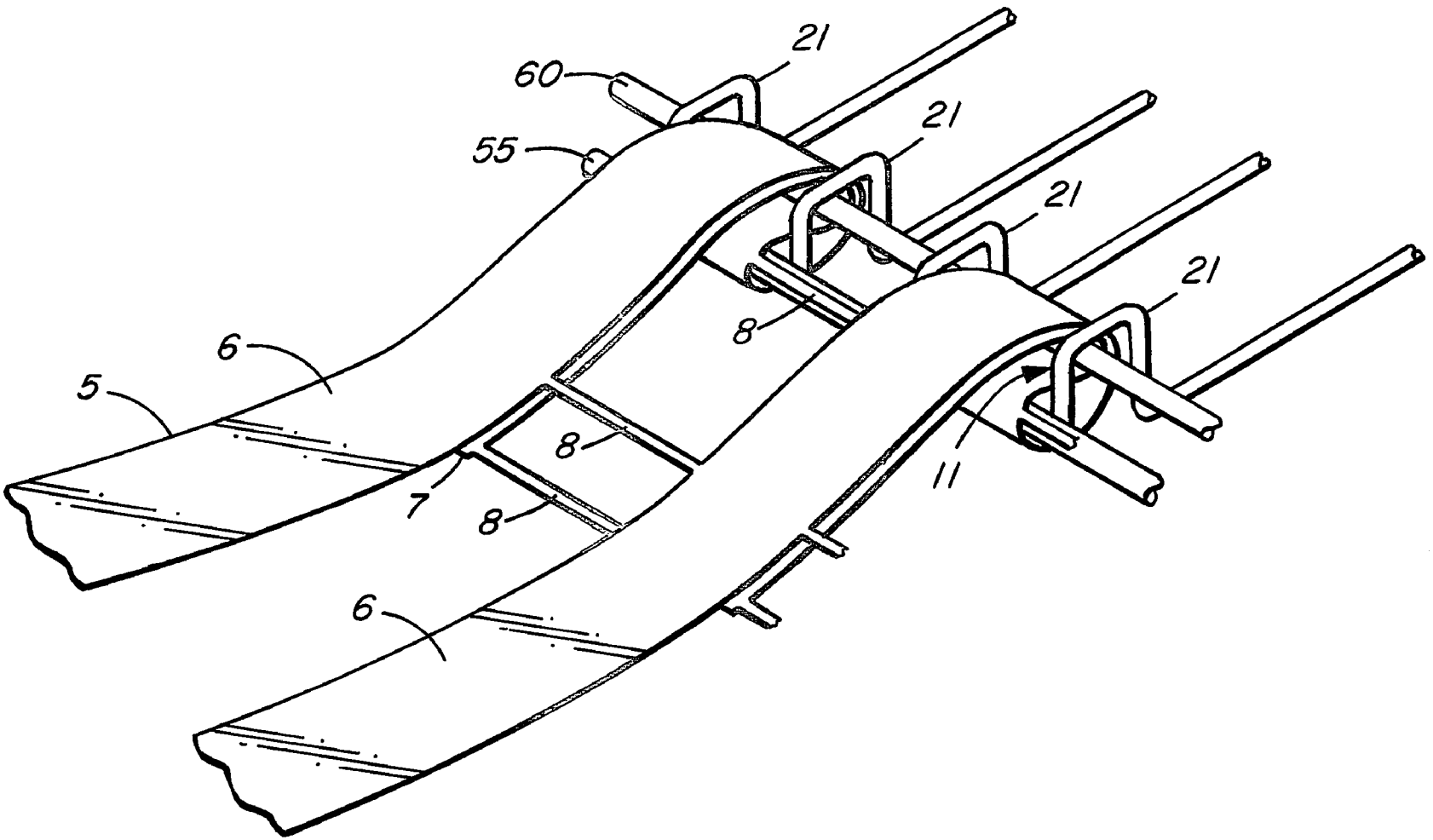

Next, as indicated in FIGS. 9 and 10 by arrows 104 and 105, both the forward portion and the remaining extension of geogrid 5 are folded rearwardly over anchoring rod 60 to the position shown in FIG. 10. Geogrid 5 is then situated to be tensioned to the position shown in FIG. 4 where it is tighened on rods 55, 60.

Figure 11:
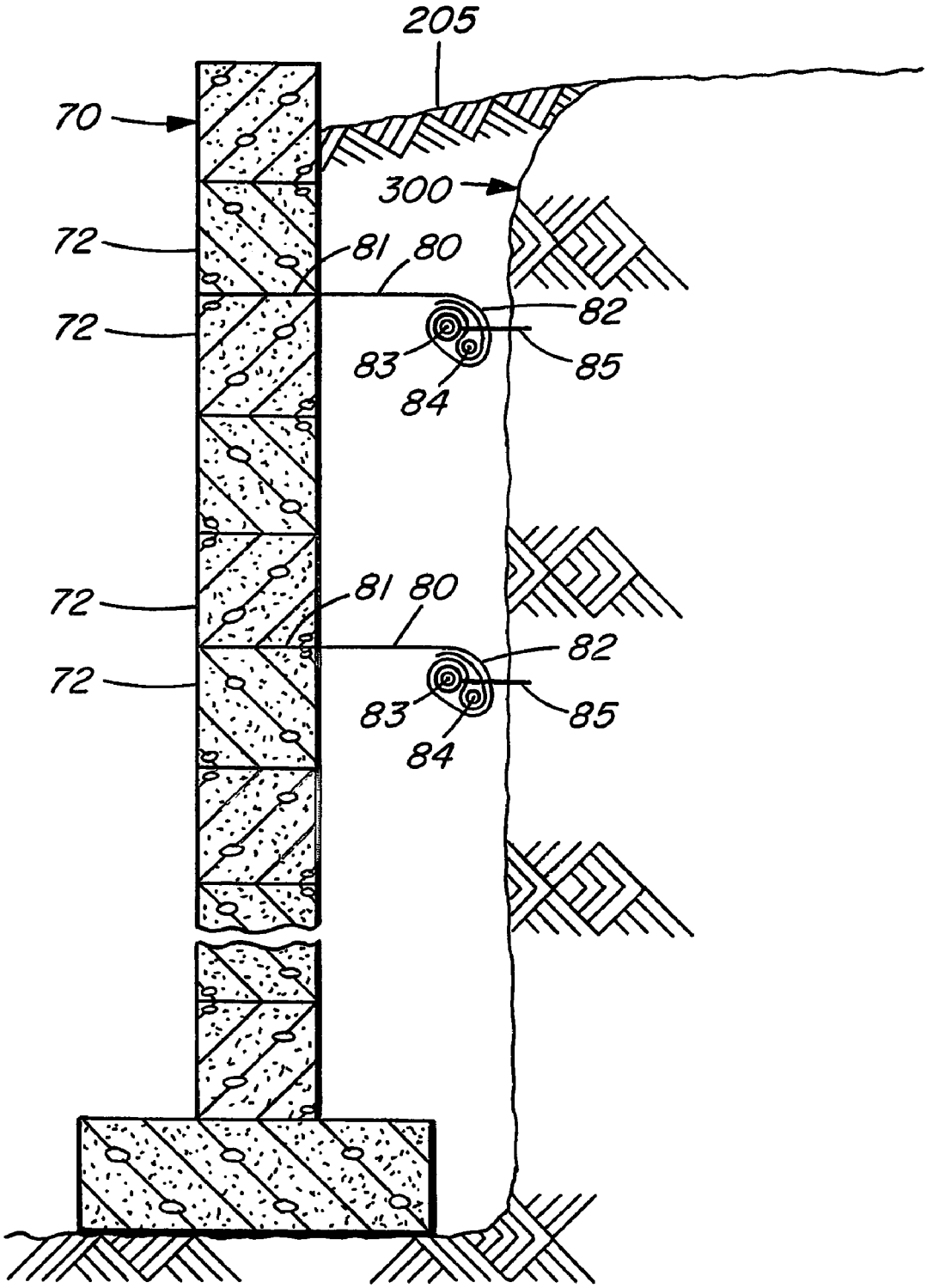
FIG. 11 is a cross-section elevation view illustrating a backfill earthen embankment contained between a retaining wall and a rock face with geogrids extending therebetween, an end portion of each of the geogrids being anchored to the rock face with apparatus in accordance with the present invention.

Other structures for supporting earthen embankments are within the scope of the present invention. For example, FIG. 11 illustrates a case where a backfill earthen embankment 205 lies between a retaining wall 70 comprised of concrete blocks 72 and a rock face 300. Flexible fiber geogrids 80 progressively installed during the process of adding the backfill each extend longitudinally through embankment 205 from a first end portion 81 held and secured between adjacent blocks 72 to a second end portion 82 secured by a pair of anchor rods 83, 84 extending transversely in relation to the geodgrid and anchor bolts 85. Only one anchor bolt 85 for each geogrid 80 is visible in FIG. 11, but it will be understood that a number of such bolts will be used for a given geogrid depending on the width of the geogrid and the load to be carried by the bolts.

Figure 12:
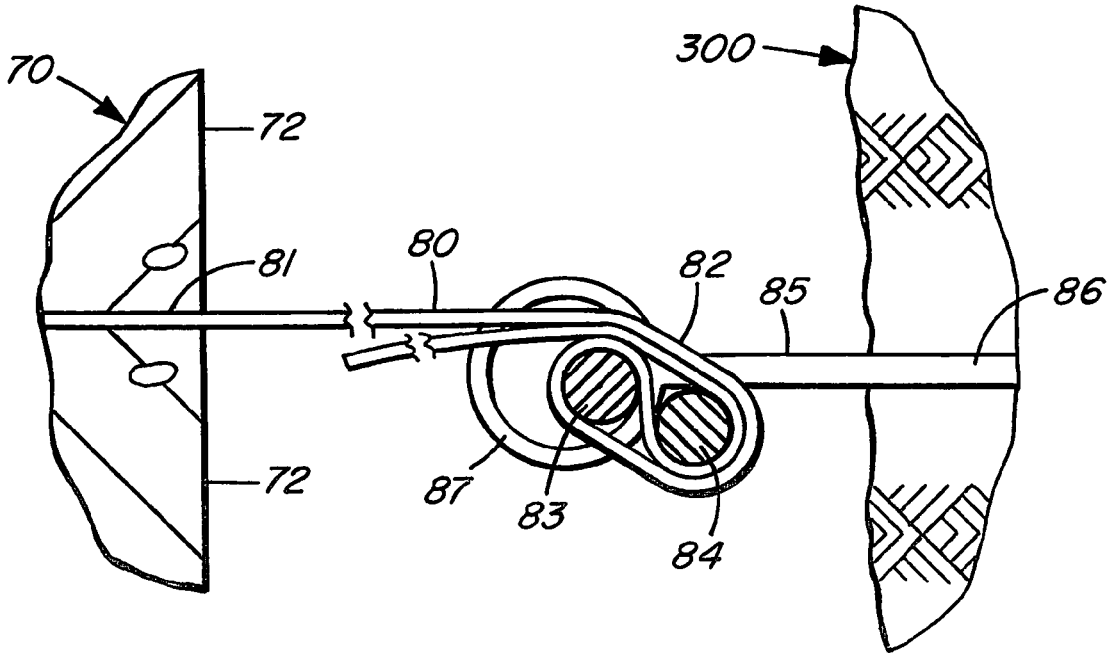
FIG. 12 is a cross-section elevation view illustrating in more detail the manner whereby the geogrids shown in FIG. 11 are anchored to the rock face shown in FIG. 11.

As best seen in FIG. 12, each bolt 85 comprises a shaft 86 extending from one end engaged (e.g. by threading) with rock face 300 to a distal end shaped to form an eyelet 87. Rod 83 extends longitudinally through eyelet 87 and bears against the inside lower right quadrant thereof. Rod 84 bears against shaft 86 and the outside lower right quadrant of eyelet 87. Bolt 85 thereby limits movement of rods 83, 84. In much the same manner as shown in FIG. 5 where the forward end of geogrid 5 is wrapped back and forth around anchor rods 55, 60, end 82 of geogrid 80 is wrapped back and forth around anchor rods 83, 84 so as to tighten on the rods when geogrid 80 is pulled in longitudinal tension. (Typically, each geogrid 80 will be pulled and held in tension during construction when its end portion 81 is being secured between adjacent blocks 72.

Figure 13:
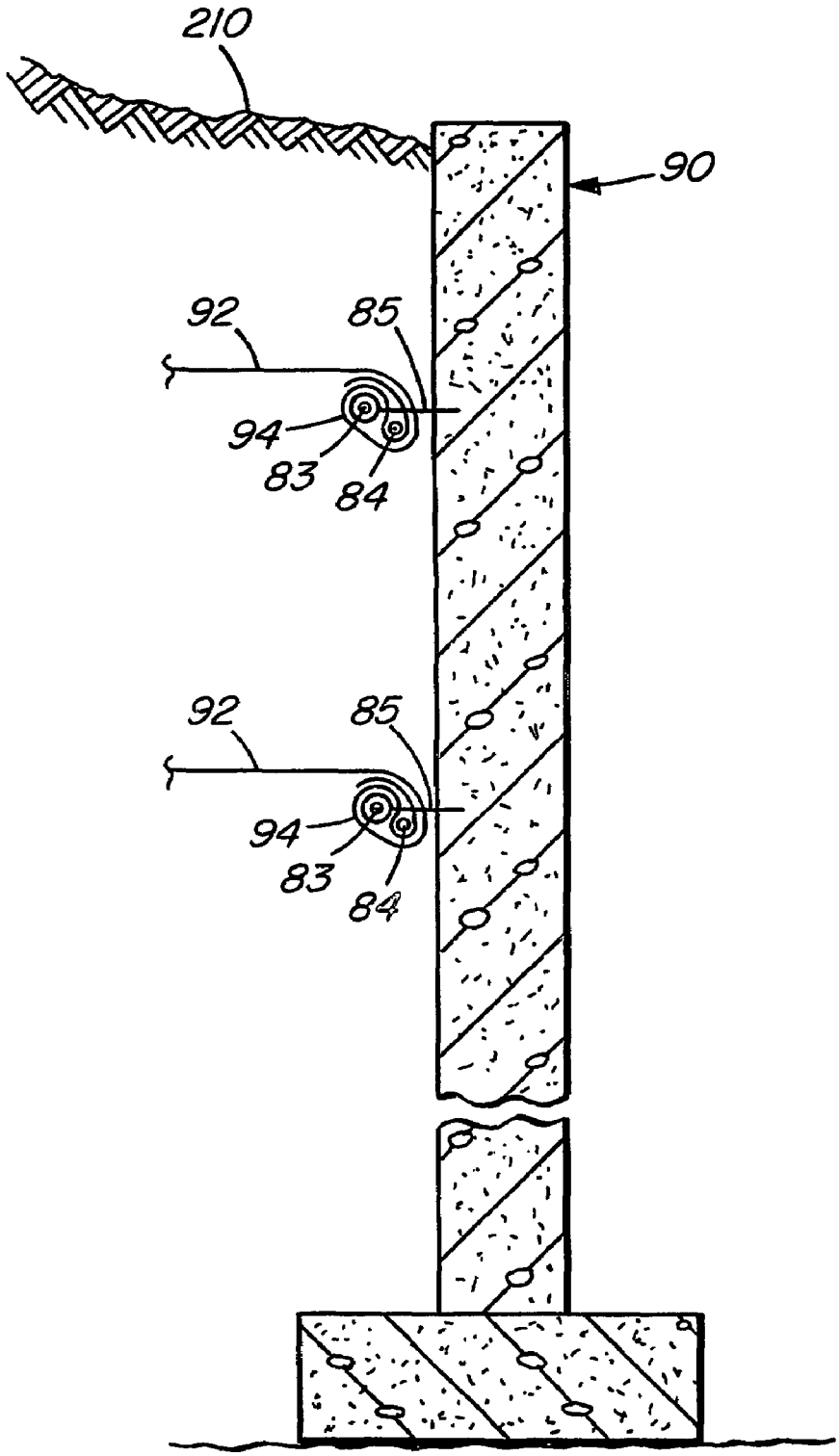
FIG. 13 is a cross-section elevation view illustrating a backfill earthen embankment stabilized by a retaining wall and geogrids, the geogrids being anchored to the retaining wall with apparatus in accordance with the present invention.

As another example, FIG. 13 illustrates a case where a backfill earthen embankment 210 is stabilized by a solid concrete retaining wall generally designated 90. Flexible fiber geogrids 92 progressively installed during the process of adding the backfill extend from wall 90 into embankment 210. An end portion 94 of each geogrid is anchored to wall 90 by means of anchor rods 83, 84 and anchor bolts 85, the latter of which are engaged with wall 90 rather than a rock face as in the case of the embodiment shown in FIG. 11. Since the anchoring mechanism is otherwise essentially the same as the anchoring mechanism described in relation to FIGS. 11-12, it will not be described here in any further detail.

Figure 14:
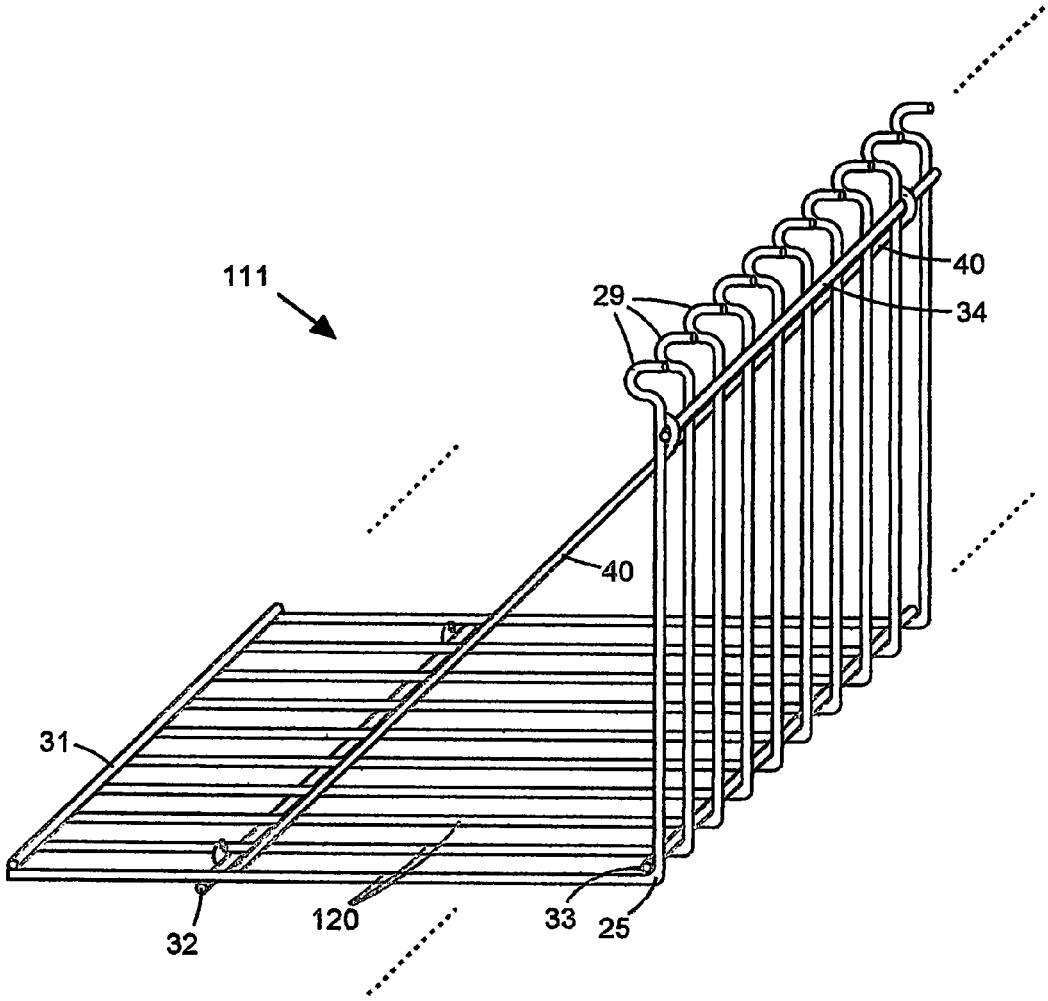
FIG. 14 is a perspective view of an alternative embankment support.
Figure 15:
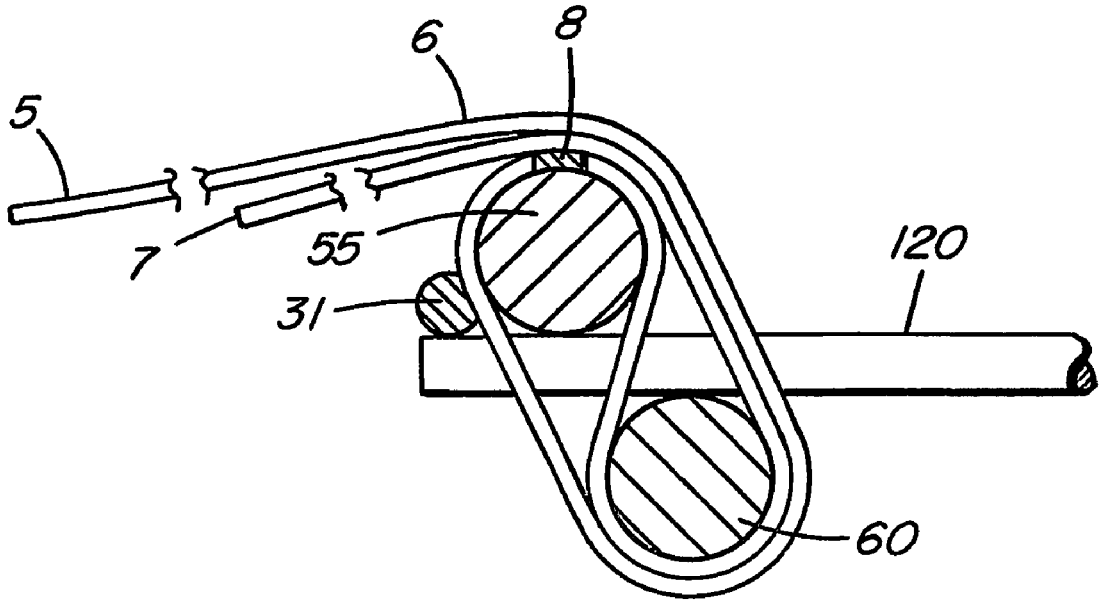
FIG. 15 is a cross-section elevation view illustrating the anchoring of a flexible fiber geogrid to the embankment support shown in FIG. 14.

As a further example, it should be noted that embankment supports like support 11 can be used but without hooked rearward ends 21. While considered preferable, such hooked ends are not considered essential. More particularly, FIG. 14 shows an embankment support 111 which is similar in construction to support 11, but with a plurality of transversely spaced elongated steel wire members 120 instead of wire members 20. In the floor section of support 111, wire members 120 have straight rearward ends rather than hooked rearward ends 21. Crossbar 31 extends across the top of the straight rearward ends. FIG. 15 shows the manner whereby a geogrid 5 is anchored to the rearward end of the floor section of support 111 by wrapping the geogrid back and forth around anchor rods 55, 60. Rod 55 abuts against crossbar 31 and against the tops of wire members 120. Rod 60 abuts against the bottoms of wire members 120. Movement of the rods 55, 60 is thereby limited.

Further Variations

A variety of modifications, changes and variations to the invention are possible within the spirit and scope of the following claims, and will undoubtedly occur to those skilled in the art. The invention should not be considered as restricted to the specific embodiments that have been described and illustrated with reference to the drawings. In the claims, means-plus-function clauses are intended to cover the structures described herein as performing the recited function and not only structural equivalents but also equivalent structures.

I claim:

1. A structure for stabilizing an earthen embankment, said structure comprising:

(a) an embankment support for restraining movement of at least a part of said embankment;

(b) a flexible fiber geogrid extending longitudinally through said embankment from a first end portion secured to said support to a second end portion; and, (c) anchor means for securing one of said end portions, said anchor means comprising:

(i) a pair of anchor rods spaced away from said embankment support and extending transversely in relation to said geogrid; and, (ii) means for limiting movement of said anchor rods, said one of said end portions being wrapped back and forth around said anchor rods so as to tighten thereon when said geogrid is pulled in longitudinal tension away from said anchor means.

2. A structure as defined in claim 1 wherein:

(a) said support comprises a retaining wall; and, (b) said means for limiting movement of said anchor rods comprises a plurality of anchor bolts, each bolt comprising a shaft extending from one end engaged with said wall to a distal end shaped to form an eyelet, one of said anchor rods extending through each of said eyelets.

3. A structure as defined in claim 1, wherein:

(a) said support comprises a retaining wall, (b) said earthen embankment lies between a rock face and said wall; and, (c) said means for limiting movement of said anchor rods comprises a plurality of anchor bolts, each bolt comprising a shaft extending from one end engaged with said rock face to a distal end shaped to form an eyelet, one of said anchor rods extending through each of said eyelets.

4. A structure for stabilizing an earthen embankment, said structure comprising:

(a) an embankment support for restraining movement of at least a part of said embankment, said support comprising:

(i) a floor section extending longitudinally rearwardly from a forward end of the floor section to a rearward end of the floor section, said rearward end of the floor section including a plurality of transversely spaced hooking members; and, (ii) a face section extending longitudinally at an angle upwardly from said forward end of the floor section to a top end; and;

(b) a flexible fiber geogrid extending longitudinally rearwardly from said floor section and anchored thereto by first and second anchor rods engaging said hooking members and extending transverse to said geogrid, said first anchor rod being positioned rearward of said second anchor rod; movement of said anchor rods relative to said support being limited by said hooking members when said geogrid is pulled in rearward longitudinal tension.

5. A structure as defined in claim 4, wherein:

(a) each of said hooking members defines an inverted U-shaped envelope, said second anchor rod extending through the envelope of each of said hooking members, said first anchor rod extending outside the envelope of each of said hooking members; and, (b) said geogrid extends from a forward end of said geogrid:

(i) first forwardly above said first anchor rod to a position above said second anchor rod;

(ii) then wrapping around said second anchor rod to a position below said second anchor rod;

(iii) then rearwardly to a position above said first anchor rod;

(iv) then wrapping around said first anchor rod to a position below said first anchor rod;

(v) then forwardly to a position below said second anchor rod;

(vi) then wrapping around said second anchor rod to a position above said second anchor rod;

(vii) then rearwardly above said first anchor rod and away from said support.

6. A structure as defined in claim 4, wherein:

(a) said support includes a transversely extending crossbar positioned proximate to said forward end of said floor section; and, (b) said top end of said face section includes a plurality of transversely spaced hooks for engaging a like crossbar of a like support.

7. A structure as defined in claim 6, wherein:

(a) each of said hooking members defines an inverted U-shaped hooking envelope, said second anchor rod extending through the hooking envelope of each of said hooking members, said first anchor rod extending outside the envelope of each of said hooking members; and, (b) said geogrid extends from a forward end of said geogrid:

(i) first forwardly above said first anchor rod to a position above said second anchor rod;

(ii) then wrapping around said second anchor rod to a position below said second anchor rod;

(iii) then rearwardly to a position above said first anchor rod;

(iv) then wrapping around said first anchor rod to a position below said first anchor rod;

(v) then forwardly to a position below said second anchor rod;

(vi) then wrapping around said second anchor rod to a position above said second anchor rod;

(vii) then rearwardly above said first anchor rod and away from said support.

8. A structure for stabilizing an earthen embankment, said structure comprising:

(a) an embankment support for restraining movement of at least a part of said embankment, said support comprising:

(i) a plurality of parallel spaced elongated wire members, each extending longitudinally from a hooked rearward end to a forward end then upwardly to an upper end; said wire members together defining a floor section of said support and a face section of said support; and, (ii) a plurality of transversely extending crossbars secured to said wire members for holding said wire members in said parallel spaced relationship; and;

(b) a flexible fiber geogrid extending longitudinally rearwardly from said floor section and anchored thereto by first and second anchor rods engaging said hooked rearward ends and extending transverse to said geogrid, said first anchor rod being positioned rearward of said second anchor rod; movement of said anchor rods relative to said support being limited by said hooked rearward ends when said geogrid is pulled in rearward longitudinal tension.

9. A structure as defined in claim 8, wherein:

(a) each of said hooked rearward ends defines an inverted U-shaped envelope, said second anchor rod extending through the envelope of each of said hooked rearward ends, said first anchor rod extending outside the envelope of each of said hooked rearward ends; and, (b) said geogrid extends from a forward end of said geogrid:

(i) first forwardly above said first anchor rod to a position above said second anchor rod;

(ii) then wrapping around said second anchor rod to a position below said second anchor rod;

(iii) then rearwardly to a position above said first anchor rod;

(iv) then wrapping around said first anchor rod to a position below said first anchor rod;

(v) then forwardly to a position below said second anchor rod;

(vi) then wrapping around said second anchor rod to a position above said second anchor rod;

(vii) then rearwardly above said first anchor rod and away from said support.

10. A structure as defined in claim 8, wherein:

(a) one of said crossbars is a forward crossbar extending proximate to said forward ends of said wire members; and, (b) said upper end of each of said wire members is hooked for engaging a like forward crossbar of a like support.

11. A structure as defined in claim 10, wherein:

(a) each of said hooked rearward ends defines an inverted U-shaped envelope, said second anchor rod extending through the envelope of each of said hooked rearward ends, said first anchor rod extending outside the envelope of each of said hooked rearward ends; and, (b) said geogrid extends from a forward end of said geogrid:

(i) first forwardly above said first anchor rod to a position above said second anchor rod;

(ii) then wrapping around said second anchor rod to a position below said second anchor rod;

(iii) then rearwardly to a position above said first anchor rod;

(iv) then wrapping around said first anchor rod to a position below said first anchor rod;

(v) then forwardly to a position below said second anchor rod;

(vi) then wrapping around said second anchor rod to a position above said second anchor rod;

(vii) then rearwardly above said first anchor rod and away from said support.

12. A method of anchoring a flexible fiber geogrid to a support for stabilizing an earthen embankment, said support comprising an upwardly extending face section and a floor section extending longitudinally rearwardly from said face section, said floor section comprising a plurality of transversely spaced hooking members, said geogrid comprising longitudinally extending webs sized and spaced to fit between said hooking members; said method comprising:

(a) positioning a forward end portion of said geogrid atop said floor section such that said longitudinally extending webs extend between said hooking members;

(b) then positioning a first anchor rod atop said end portion rearward of said hooking members;

(c) then folding said end portion forwardly over said first anchor rod;

(d) then positioning a second anchor rod atop said end portion forward of said first anchor rod;

(e) then folding said end portion and said geogrid rearwardly over said second anchor rod.

13. A method as defined in claim 12, wherein said support comprises a plurality of parallel spaced elongated wire members, each of said wire members extending longitudinally from a rearward end to a forward end then upwardly to an upper end; said wire members together defining said floor section of said support and said face section of said support; each of said wire members including one of said hooking members at its rearward end.

14. A method as defined in claim 12, wherein each of said hooking members defines an inverted U-shaped envelope, and wherein said method comprises:

(a) positioning said first anchor rod rearward of said envelope; and, (b) inserting said second anchor rod progressively through the envelope of each of said hooking members to a position extending through the envelope of all of said hooking members.

15. A method as defined in claim 14, wherein said support comprises a plurality of parallel spaced elongated wire members, each of said wire members extending longitudinally from a rearward end to a forward end then upwardly to an upper end; said wire members together defining said floor section of said support and said face section of said support; each of said wire members including one of said hooking members at its rearward end.

* * * * *